US010801731B2

(12) United States Patent
Dillard

(10) Patent No.: US 10,801,731 B2
(45) Date of Patent: Oct. 13, 2020

(54) ATTACHMENT FOR HIGH TEMPERATURE CMC COMBUSTOR PANELS

(71) Applicant: United Technologies Corporation, Farmington, CT (US)

(72) Inventor: Gary J. Dillard, Gainesville, FL (US)

(73) Assignee: United Technologies Corporation, Farmington, CT (US)

( * ) Notice: Subject to any disclaimer, the term of this patent is extended or adjusted under 35 U.S.C. 154(b) by 141 days.

(21) Appl. No.: 16/129,918

(22) Filed: Sep. 13, 2018

(65) Prior Publication Data

US 2020/0088410 A1 Mar. 19, 2020

(51) Int. Cl.
*F23R 3/60* (2006.01)
*F23R 3/00* (2006.01)

(52) U.S. Cl.
CPC ..... *F23R 3/60* (2013.01); *F23R 3/007* (2013.01); *F05D 2300/6033* (2013.01); *F23R 2900/00017* (2013.01)

(58) Field of Classification Search
CPC .. F23R 3/60; F23R 3/007; F23R 2900/00017; F23R 3/002; F23M 5/04
See application file for complete search history.

(56) References Cited

U.S. PATENT DOCUMENTS 4,302,932 A 12/1981 Kuznetsov et al.
4,688,310 A 8/1987 Kelm et al.
6,397,603 B1 * 6/2002 Edmondson ..... F23R 3/007 60/746
6,449,952 B1 * 9/2002 Emilianowicz ..... F01D 25/243 60/752
9,423,130 B2 8/2016 Prociw et al.
9,651,258 B2 5/2017 Graves et al.
2011/0185740 A1 8/2011 Dieberger et al.
2014/0360196 A1 12/2014 Graves et al.
2015/0107109 A1 4/2015 Corsmeier et al.
2017/0159936 A1 * 6/2017 Cunha ..... F23R 3/005

FOREIGN PATENT DOCUMENTS

EP 1420208 A1 5/2004
WO WO2018087878 A1 5/2018

OTHER PUBLICATIONS

Extended European Search Report for EP Application No. 19197102.7, dated Jan. 7, 2020, 8 pages.

* cited by examiner

*Primary Examiner* — Todd E Manahan
*Assistant Examiner* — Katheryn A Malatek
(74) *Attorney, Agent, or Firm* — Kinney & Lange, P.A.

(57) ABSTRACT

A combustor panel for use in a gas turbine engine includes a body portion having an outwardly curved edge defining a channel between the body portion and the outwardly curved edge. The outwardly curved edge includes a plurality of slots. The panel further includes a fastening member having a base disposed within the channel and a plurality of fasteners extending from the base and disposed within the slots.

19 Claims, 4 Drawing Sheets

ATTACHMENT FOR HIGH TEMPERATURE CMC COMBUSTOR PANELS

BACKGROUND

A typical gas turbine engine combustor can include metallic liners and liner panels coated with a thermal barrier coating. Metallic panels are thermally limited as far as maximum operating temperatures and require large amounts of cooling air to meet full life cycle requirements. Ceramic matrix composite (CMC) panels have higher temperature capabilities compared to metallic panels, and are typically lighter in weight than metal panels. However, attaching CMC panels to the liners and existing metallic support structures of the combustor can be challenging due to thermal expansion differences between metals and CMC materials, as well as poor localized stress loading at attachment points.

SUMMARY

A combustor panel for use in a gas turbine engine includes a body portion having an outwardly curved edge defining a channel between the body portion and the outwardly curved edge. The outwardly curved edge includes a plurality of slots. The panel further includes a fastening member having a base disposed within the channel and a plurality of fasteners extending from the base and disposed within the slots.

A combustor liner assembly for a gas turbine engine combustor includes at least one liner and at least one panel secured to the at least one liner. The at least one panel includes a body portion having an outwardly curved edge defining a channel between the body portion and the outwardly curved edge. The outwardly curved edge includes a plurality of slots. The at least one panel further includes a fastening member having a base disposed within the channel and a plurality of fasteners extending from the base and disposed within the slots.

DETAILED DESCRIPTION

The present invention is directed to a gas turbine engine assembly including one or more ceramic matrix composite liner (CMC) panels and associated attachment componentry. The CMC panels are formed with attachment flanges for use in securing the panels to a metallic liner. This allows the metal-CMC attachment interface to be situated away from the hot, inner side of the panel, which reduces thermal stress on the interface.

Figure 1:
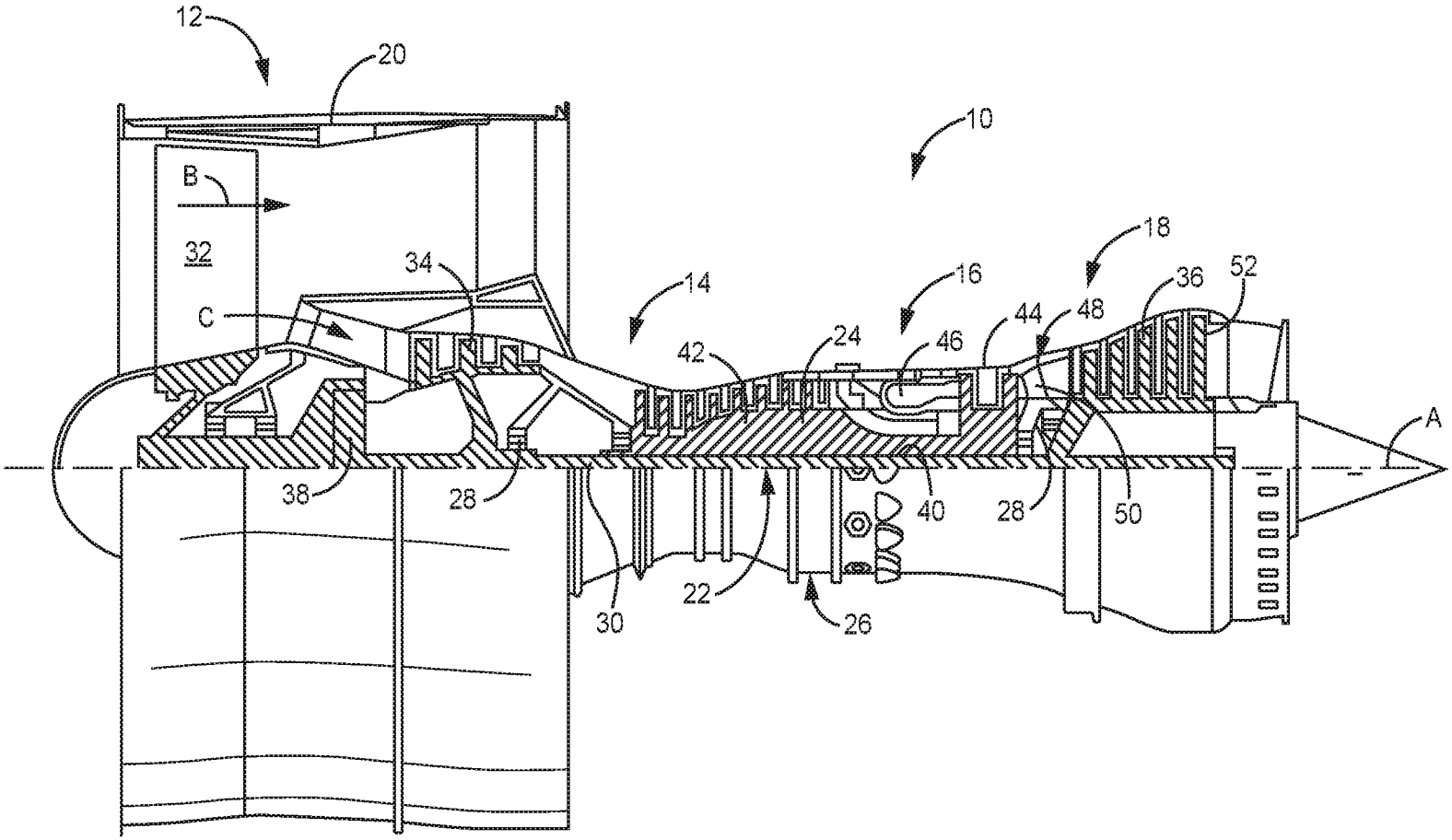
FIG. 1 schematically illustrates an example gas turbine engine.

FIG. 1 schematically illustrates a gas turbine engine 10. The gas turbine engine 10 is disclosed herein as a two-spool turbofan that generally incorporates a fan section 12, a compressor section 14, a combustor section 16 and a turbine section 18. The fan section 12 drives air along a bypass flow path B in a bypass duct defined within a nacelle 20, while the compressor section 14 drives air along a core flow path C for compression and communication into the combustor section 16 then expansion through the turbine section 18. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 10 generally includes a low speed spool 22 and a high speed spool 24 mounted for rotation about an engine central longitudinal axis A relative to an engine static structure 26 via several bearing systems 28. It should be understood that various bearing systems 28 at various locations may alternatively or additionally be provided, and the location of bearing systems 28 may be varied as appropriate to the application.

The low speed spool 22 generally includes an inner shaft 30 that interconnects a fan 32, a first (or low) pressure compressor 34 and a first (or low) pressure turbine 36. The inner shaft 30 is connected to the fan 32 through a speed change mechanism, which in exemplary gas turbine engine 10 is illustrated as a geared architecture 38 to drive the fan 32 at a lower speed than the low speed spool 22. The high speed spool 24 includes an outer shaft 40 that interconnects a second (or high) pressure compressor 42 and a second (or high) pressure turbine 44. A combustor 46 is arranged in exemplary gas turbine 10 between the high pressure compressor 42 and the high pressure turbine 44. A mid-turbine frame 48 of the engine static structure 26 is arranged generally between the high pressure turbine 44 and the low pressure turbine 36. The mid-turbine frame 48 further supports bearing systems 28 in the turbine section 18. The inner shaft 30 and the outer shaft 40 are concentric and rotate via bearing systems 28 about the engine central longitudinal axis A which is collinear with their longitudinal axes.

The core airflow is compressed by the low pressure compressor 34 then the high pressure compressor 42, mixed and burned with fuel in the combustor 46, then expanded over the high pressure turbine 44 and low pressure turbine 36. The mid-turbine frame 48 includes airfoils 50 which are in the core airflow path C. The turbines 36, 44 rotationally drive the respective low speed spool 22 and high speed spool 24 in response to the expansion. It will be appreciated that each of the positions of the fan section 12, compressor section 14, combustor section 16, turbine section 18, and fan drive gear system 38 may be varied. For example, gear system 38 may be located aft of combustor section 16 or even aft of turbine section 18, and fan section 12 may be positioned forward or aft of the location of gear system 38.

The engine 10 in one example is a high-bypass geared aircraft engine. In a further example, the engine 10 bypass ratio is greater than about six (6), with an example embodiment being greater than about ten (10), the geared architecture 38 is an epicyclic gear train, such as a planetary gear system or other gear system, with a gear reduction ratio of greater than about 2.3 and the low pressure turbine 36 has a pressure ratio that is greater than about five. In one disclosed embodiment, the engine 10 bypass ratio is greater than about ten (10:1), the fan diameter is significantly larger than that of the low pressure compressor 34, and the low pressure turbine 36 has a pressure ratio that is greater than about five 5:1. Low pressure turbine 36 pressure ratio is pressure measured prior to inlet of low pressure turbine 36 as related to the pressure at the outlet of the low pressure turbine 36 prior to an exhaust nozzle. The geared architecture 38 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 12 of the engine 10 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
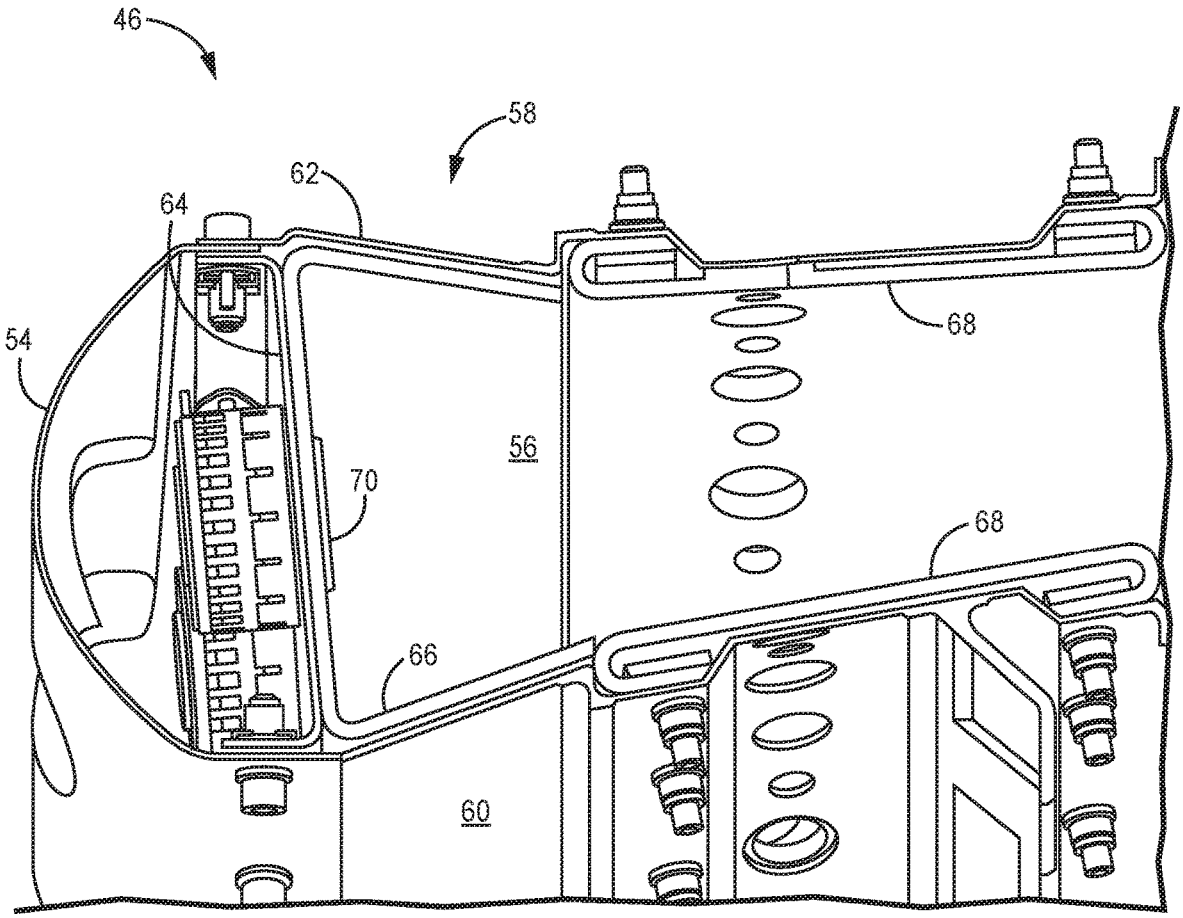
FIG. 2 is a partial cross-section of a gas turbine engine combustor having ceramic matrix composite panels.

FIG. 2 is a partial cross-section of combustor 46 showing hood 54, combustion chamber 56, and combustor assembly 58 defining combustion chamber 56. As shown, combustor 46 has a "kinked" configuration, as is known in the art. Assembly 58 includes radially inner and outer liners 60 and 62, respectively, as well as bulkhead liner 64, forward panel ring 66, and inner and outer aft panels 68. Bulkhead liner 64 can be secured to hood 54, and can include openings to accommodate swirlers 70. Hood 54, liners 60 and 62, and bulkhead liner 64 can be formed from a metallic material, such as a nickel alloy, and can further include a high temperature coating.

Forward panel ring 66 abuts bulkhead liner 64 and need not be secured to liners 60 and 62 with fasteners. Rather, radial and axial displacement of forward panel ring 66 can be prevented by an interference fit between forward panel ring 66, liners 60 and 62, and bulkhead liner 64 respectively. In the embodiment shown, panel ring 66 is a one-piece annular structure, but can alternatively be formed as multiple annular components (e.g., outer panel, inner panel, bulkhead panel) and/or arcuate segments of the annulus, depending on manufacturing capabilities and/or the particular geometry of liners 60 and 62. Depending on thermal and structural requirements, panel ring 66 can be formed from a metallic material, a CMC material, or a combination of the two, with, for example, the forward portion abutting bulkhead liner 62 being a metallic material, and the axially extending portions being a CMC material.

Figure 3:
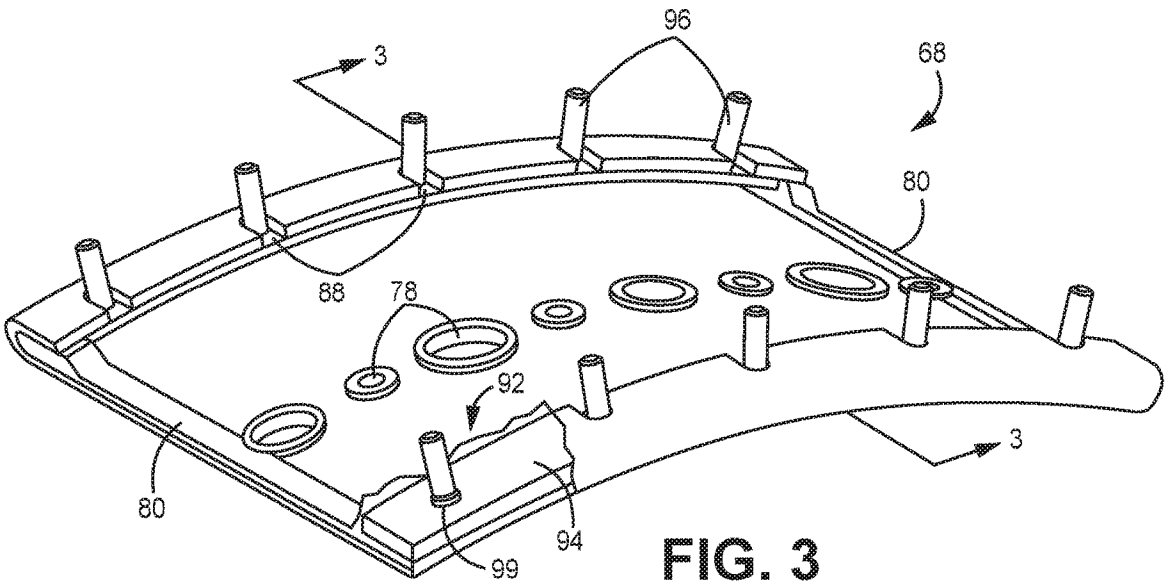
FIG. 3 is a perspective view of an individual panel and associated attachment hardware.
Figure 4:
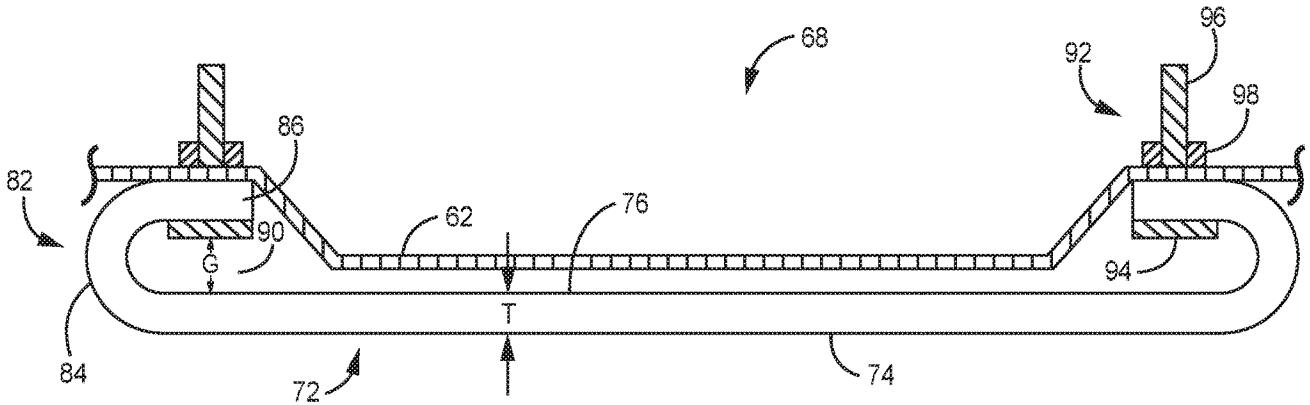
FIG. 4 is a cross-section of the panel.

FIGS. 3 and 4 are perspective and cross-sectional views, respectively, of the radially outer aft panel 68. Although FIGS. 3 and 4 specifically show aft panel 68 in an outer aft panel arrangement, the present invention can additionally or alternatively be utilized in an inner aft panel arrangement.

With continued reference to FIGS. 2-4, aft panel 68 can include a body portion 72 having an inner, hot side surface 74 in communication with combustion chamber 56, and an outer, cold side surface 76 on the side opposite combustion chamber 56. Body portion 72 can include a number of dilution holes 78, and seals 80 can be disposed along the axial edges of body portion 72 on cold side surface 76. Seals 80 can be formed from a CMC or metallic material, depending on thermal requirements and/or material availability. Seals 80 can further be distinct seal members in an exemplary embodiment, but can alternatively be formed as sealing surfaces on body portion 72. Body portion 72 can have a thickness T that, in an exemplary embodiment, can range nominally from about 80-100 mil (0.08 in-0.10 in). Body portion 72 can be thicker or thinner, depending on the particular arrangement of the CMC material and/or thermal requirements.

Aft panel 68 further includes outwardly curved edges 82 forward and aft of body portion 72. Curved edges 82 are curved outward about 180° giving the edges a "U" shape. Each curved edge 82 can include a curved region 84, a flange 86 generally parallel to body portion 72, and a plurality of slots 88 circumferentially disposed along flange 86. Each curved edge 82 defines a channel 90 into which fastening member 92 can be inserted, as is discussed in detail below. Aft panels 68 can be formed from a CMC material, such as a silicon-carbide or other suitable CMC material impregnated with a resin. The CMC material can have a woven structure, or can be formed as a lay-up of individual plies. Outwardly curved edges 82 are formed by curing aft panels 26 on a specialized tool. In an exemplary embodiment, outwardly curved edges 82 are formed having a bend radius of 1T (i.e., the thickness of body portion 72), but other bend radii can be used depending on the desired geometry of curved edges 82. Aft panel 68 is shown in FIG. 4 having generally uniform thickness of body portion 72 and curved edges 82. In an alternative embodiment, aft panel 68 can be thickened, for example, at curved edges 82 to improve mechanical properties in that region. The curved geometry of curved edges 82 also allows for greater distribution of stresses through aft panel 68 when fastened to the liner, compared to configurations in which metal fasteners are attached to/extend through CMC panel bodies.

In FIG. 3, a portion of curved edge 82 has been removed to better illustrate fastening member 92, which can be formed from a metallic material, and further can be cast as a single piece. Fastening member 92 can include an elongate base 94 in a strip-like configuration and commensurate in length to curved edge 82. Fastening member 92 can further include a plurality of studs 96 extending radially from base 94, spaced at intervals allowing the studs to match with and extend radially through slots 88 of flange 86. When inserted into channel 90 created by curved edge 82, a gap G exists between cold side surface 76 of body portion 72 and elongate base 94. Aft panel 68 can be secured to liner 62 by matching studs 96 to corresponding holes within liner 62 and tightening a nut 98 (shown in FIG. 4) around one or more of studs 96. A thickened shoulder portion 99 can be provided at the base of one or more studs 96 to act as a stop for nut 98.

In operation of combustor 46, hot side surface 74 of aft panel 68 can be exposed to hot fluid within combustion chamber 56. Flanges 86, fastening members 92, and the attachment region of liner 62 remain relatively cool, as they are positioned on the cold side of assembly 58. Further, a cooling flow can be provided through gap G to thermally regulate the attachment components. This allows for control of thermal expansion of the CMC material relative to the metal components (i.e., liner 62, fastening member 92, and nut 98). Further, slots 88 can be shaped and sized to accommodate thermal expansion of studs 96.

Figure 5:
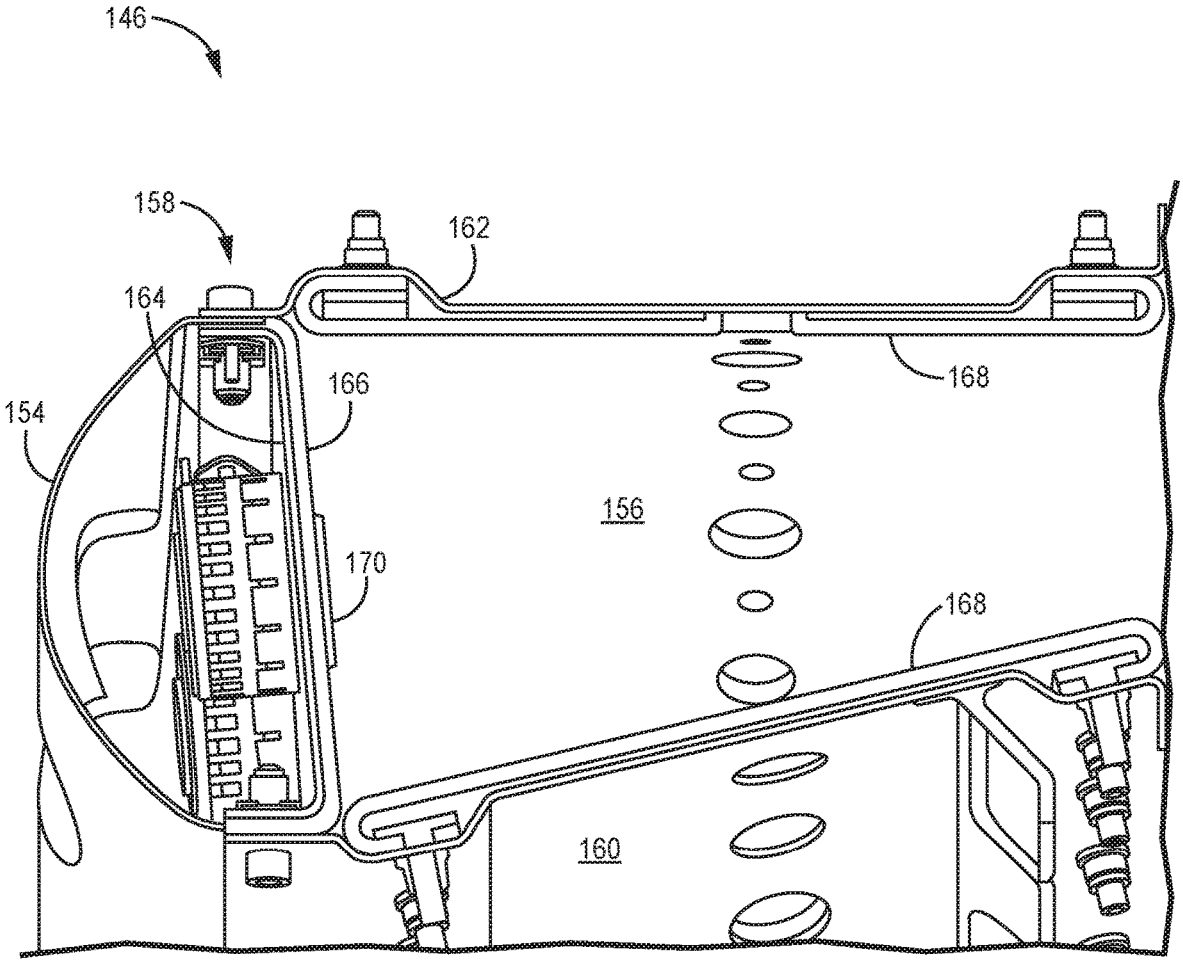
FIG. 5 is a partial cross-section of an alternative gas turbine engine combustor having ceramic matrix composite panels.

FIG. 5 is a partial cross-section of alternative gas turbine engine combustor 146, which is operationally similar to combustor 46, but with fewer panels and in a straight wall configuration. Combustor 146 includes hood 154 and combustion chamber 156 defined by combustor assembly 158. Assembly 158 includes radially inner and outer support liners 160 and 162, respectively, as well as bulkhead liner 164, forward panel ring 166 and aft panels 168. Hood 154, liners 160 and 162, and bulkhead liner 164 can be formed from the same metallic material(s) as the corresponding components of combustor 46.

Forward panel ring 166 can be similar to panel ring 66 with respect to materials, but as shown in FIG. 5, has a different cross-sectional geometry, and is arranged such that bulkhead liner 164 is nested within it. Because of this positioning, the shape of panel ring 166 generally corresponds to that of bulkhead liner 164. Liner assembly 158 further includes inner and outer aft panels 168, which can also be substantially similar to aft panels 68, particularly with respect to materials, manufacturing, and structural properties. Because of the straight wall configuration of combustor 146, aft panels 168 may geometrically differ from panels 68 (e.g., in area, thickness, etc.) as well as in the total number of aft panels 168 required for liner assembly 158.

The disclosed CMC combustor assemblies provide improved thermal capabilities over current metallic assemblies, as well as improved attachment componentry and structural durability over current CMC assemblies. The disclosed assemblies can advantageously be used in existing combustor architecture. In addition to aerospace applications, the disclosed assemblies and/or attachment means can be used in marine or industrial applications, to name a few non-limiting examples.

DISCUSSION OF POSSIBLE EMBODIMENTS

The following are non-exclusive descriptions of possible embodiments of the present invention.

A combustor panel for use in a gas turbine engine includes a body portion having an outwardly curved edge defining a channel between the body portion and the outwardly curved edge. The outwardly curved edge includes a plurality of slots. The panel further includes a fastening member having a base disposed within the channel and a plurality of fasteners extending from the base and disposed within the slots.

The panel of the preceding paragraph can optionally include, additionally and/or alternatively, any one or more of the following features, configurations and/or additional components:

In the above panel, the body portion can include an inner surface and an outer surface, and wherein a gap exists between the base and the outer surface.

In any of the above panels, the panel can be formed from a ceramic matrix composite material.

In any of the above panels, the fastening member can be formed from a metallic material.

In any of the above panels, the panel can have first coefficient of thermal expansion, and the fastening member can have a second coefficient of thermal expansion different from the first coefficient of thermal expansion.

Any of the above panels can further include a locking nut fitted over at least one of the plurality of fasteners.

A combustor liner assembly for a gas turbine engine combustor includes at least one liner and at least one panel secured to the at least one liner. The at least one panel includes a body portion having an outwardly curved edge defining a channel between the body portion and the outwardly curved edge. The outwardly curved edge includes a plurality of slots. The at least one panel further includes a fastening member having a base disposed within the channel and a plurality of fasteners extending from the base and disposed within the slots.

The assembly of the preceding paragraph can optionally include, additionally and/or alternatively, any one or more of the following features, configurations and/or additional components:

In the above assembly, the body portion can include an inner surface and an outer surface, and wherein a gap exists between the base and the outer surface.

In any of the above assemblies, the at least one panel can be formed from a ceramic matrix composite material.

In any of the above assemblies, the at least one liner can be formed from a metallic material.

In any of the above assemblies, the at least one panel can have a first coefficient of thermal expansion, and the at least one liner can have a second coefficient of thermal expansion different from the first coefficient of thermal expansion.

In any of the above assemblies, the fastening member can be formed from a metallic material.

Any of the above assemblies can further include a seal disposed along an edge of the body portion.

In any of the above assemblies, the seal can be formed from a ceramic matrix composite material.

In any of the above assemblies, the at least one liner can include a first, axially extending liner and a second, radially extending liner forward of the first liner.

In any of the above assemblies, the at least one panel can include a first panel, and a second panel.

In any of the above assemblies, the second panel can be disposed forward of the first panel.

In any of the above assemblies, the second panel can be held in place by interference fit with the first liner and the second liner.

Any of the above assemblies can further include a locking nut fitted over at least one of the plurality of studs.

In any of the above assemblies, the combustor can be arranged in a kinked configuration or a straight wall configuration.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A combustor panel for use in a gas turbine engine, the panel comprising:

a body portion having an outwardly curved edge defining a channel between the body portion and the outwardly curved edge, the outwardly curved edge comprising:

a curved region;

a flange generally parallel to the body portion, such that the channel is defined by the body portion and the flange; and a plurality of slots disposed along the flange; and a fastening member comprising:

a base disposed within the channel; and a plurality of fasteners extending from the base and disposed within the slots.

2. The panel of claim 1, wherein the body portion comprises an inner surface and an outer surface, and wherein a gap exists between the base and the outer surface.

3. The panel of claim 1, wherein the panel is formed from a ceramic matrix composite material.

4. The panel of claim 1, wherein the fastening member is formed from a metallic material.

5. The panel of claim 4, wherein the panel has a first coefficient of thermal expansion, and the fastening member has a second coefficient of thermal expansion different from the first coefficient of thermal expansion.

6. The panel of claim 1 and further comprising: a locking nut fitted over at least one of the plurality of fasteners.

7. A combustor liner assembly for a gas turbine engine combustor, the assembly comprising:

at least one liner; and at least one panel secured to the at least one liner, the at least one panel comprising:

a body portion having an outwardly curved edge defining a channel between the body portion and the outwardly curved edge, the outwardly curved edge comprising:

a curved region;

a flange generally parallel to the body portion, such that the channel is defined by the body portion and the flange; and a plurality of slots disposed along the flange; and a fastening member comprising:

a base disposed within the channel; and a plurality of fasteners extending from the base and disposed within the slots.

8. The assembly of claim 7, wherein the body portion comprises an inner surface and an outer surface, and wherein a gap exists between the base and the outer surface.

9. The assembly of claim 7, wherein the at least one panel is formed from a ceramic matrix composite material.

10. The assembly of claim 9, wherein the at least one liner is formed from a metallic material.

11. The assembly of claim 10, wherein the at least one panel has a first coefficient of thermal expansion, and wherein the at least one liner has a second coefficient of thermal expansion different from the first coefficient of thermal expansion.

12. The assembly of claim 7, wherein the fastening member is formed from a metallic material.

13. The assembly of claim 7 and further comprising a seal disposed along an edge of the body portion, wherein the seal is formed from a ceramic matrix composite material.

14. The assembly of claim 7, wherein the at least one liner comprises a first, axially extending liner and a second, radially extending liner forward of the first axially extending liner.

15. The assembly of claim 14, wherein the at least one panel comprises a first panel, and a second panel.

16. The assembly of claim 15, wherein the second panel is disposed forward of the first panel.

17. The assembly of claim 16, wherein the second panel is held in place by interference fit with the first liner and the second liner.

18. The assembly of claim 7 and further comprising: a locking nut fitted over at least one of the plurality of fasteners.

19. The assembly of claim 7, wherein the combustor is arranged in a kinked configuration or a straight wall configuration.

* * * * *